US010906324B2

(12) United States Patent
Walkington et al.

(10) Patent No.: US 10,906,324 B2
(45) Date of Patent: Feb. 2, 2021

(54) CONTINUOUS INKJET PRINTERS

(71) Applicant: Domino UK Limited, Cambridge (GB)

(72) Inventors: Stuart Mark Walkington, St. Albans (GB); Richard Thomas Calhoun Bridges, Trumpington (GB); Colin Jon Partridge, Baldock (GB); Justin Chase, Elsworth (GB)

(73) Assignee: Domino UK Limited

( * ) Notice: Subject to any disclaimer, the term of this patent is extended or adjusted under 35 U.S.C. 154(b) by 0 days.

(21) Appl. No.: 16/317,628

(22) PCT Filed: Jul. 13, 2017

(86) PCT No.: PCT/GB2017/052063

§ 371 (c)(1),
(2) Date: Jan. 14, 2019

(87) PCT Pub. No.: WO2018/011585

PCT Pub. Date: Jan. 18, 2018

(65) Prior Publication Data

US 2019/0283438 A1 Sep. 19, 2019

(30) Foreign Application Priority Data

Jul. 14, 2016 (GB) ..... 1612259

(51) Int. Cl.

| | |
|---|---|
| ***B41J 2/17*** | (2006.01) |
| ***B41J 2/175*** | (2006.01) |
| ***B41J 2/185*** | (2006.01) |
| ***B41J 2/18*** | (2006.01) |
| ***B41J 2/195*** | (2006.01) |

(52) U.S. Cl.

CPC ..... *B41J 2/17556* (2013.01); *B41J 2/1721* (2013.01); *B41J 2/17596* (2013.01); *B41J 2/18* (2013.01); *B41J 2/185* (2013.01); *B41J 2/195* (2013.01); *B41J 2002/1853* (2013.01)

(58) Field of Classification Search

None

See application file for complete search history.

(56) References Cited

U.S. PATENT DOCUMENTS

| | | | | |
|---|---|---|---|---|
| 4,825,228 | A | 4/1989 | Gloeckler et al. | |
| 2006/0053902 | A1 * | 3/2006 | Good | G01F 1/40 73/861.52 |
| 2011/0001771 | A1 | 1/2011 | Heylen et al. | |

(Continued)

FOREIGN PATENT DOCUMENTS

| | | |
|---|---|---|
| GB | 2447919 | 10/2008 |
| GB | 2455775 | 6/2009 |
| GB | 2479751 | 10/2011 |

(Continued)

*Primary Examiner* — Erica S Lin

(74) *Attorney, Agent, or Firm* — Price Heneveld LLP

(57) ABSTRACT

The invention provides a method of adding solvent or make-up fluid into the gutter line of a continuous ink printer. During the addition of solvent, the vacuum level in the gutter line is monitored and maintained at a level sufficient to ensure that vacuum is maintained at the gutter. Vacuum level in the gutter line is preferably controlled by controlling the speed of a variable speed gutter pump. Noise in the gutter line is preferably used as a control over pump speed.

12 Claims, 2 Drawing Sheets

(56) References Cited

U.S. PATENT DOCUMENTS

| | | | | |
|---|---|---|---|---|
| 2011/0109684 | A1 | 5/2011 | Tomlin et al. | |
| 2012/0299989 | A1 * | 11/2012 | Prothon | B41J 2/175 347/6 |

FOREIGN PATENT DOCUMENTS

| | | | | |
|---|---|---|---|---|
| JP | S57188376 | | 11/1982 | |
| WO | 8903768 | | 5/1989 | |
| WO | 90117052 | | 11/1991 | |
| WO | WO-9817478 | A1 * | 4/1998 | B41J 2/175 |
| WO | 2009047503 | | 4/2009 | |

* cited by examiner

CONTINUOUS INKJET PRINTERS

FIELD OF THE INVENTION

This invention relates to continuous inkjet (CIJ) printers and, more particularly, to a method of and/or means for managing the addition of solvent (also referred to as make-up) during operation of a CIJ printer.

BACKGROUND TO THE INVENTION

Continuous ink jet printing involves the formation of electrically charged drops from a jet of ink, and the subsequent deflection of the charged drops by an electric field to produce an image on a print medium.

In a typical embodiment of single-jet CIJ printer, electrically conducting ink is forced through a nozzle by applying pressure to the ink. The velocity of the resulting jet of ink must be controlled. This is commonly effected by controlling the constituency of the ink in conjunction with controlling the pressure. Pressure control is usually achieved by varying the speed of the pump supplying ink to the nozzle in response to feedback from a pressure transducer; but it may also be achieved using feedback from a velocity measurement device.

A controlled sequence of drops, each with identical drop volume and with constant separation between adjacent drops, can then be formed by modulating the jet to give active and controlled drive to the natural process of jet break-up. Jet break-up is usually achieved by carefully modulating the ink pressure, in a sinusoidal manner, at fixed frequency and amplitude; or by modulating the ink velocity relative to the nozzle. A range of options and techniques to introduce pressure modulation, velocity modulation or a combination of both so that uniform drop sequences are obtained are well known in the art.

To print, charge is induced on individual drops through capacitive coupling. Desired levels of charge are induced on drops by applying a voltage to charge electrodes through which the jet is directed, the charge being applied at the time the drop separates from the jet. After charging, the drops travel through a constant electric field, formed by applying a high potential difference between two surfaces, whose field lines are perpendicular to the trajectory of the jet. The charged drops are deflected by an amount that approximately scales with the charge on the drops.

Un-charged or non-printing drops are collected by a catcher or gutter, incorporated in the print head, and returned into the system for ink re-flow and re-use.

A significant factor in the reliable operation of a continuous inkjet printer is ensuring that the gutter is capable of collecting all of the non-printing ink drops and that the collected ink is transported back to an ink reservoir.

Typically a continuous ink jet printer has a relatively small print head that is attached to the printer's ink supply system, reservoir and control electronics via a conduit that is several meters long. The removal of ink collected in the gutter is achieved by drawing the ink, along with air, through a return line located in the conduit. This is conveniently achieved using a vacuum pump.

A characteristic of CIJ printers is that solvent must be added from time to time to maintain ink properties, particularly viscosity. Viscosity is monitored at regular intervals within the system and, when the viscosity rises above a predetermined level, solvent is dosed into the printer system typically via a solenoid and vacuum pump. Whilst solvent could be added in a number of places within the system it is advantageous to add solvent into the gutter return line as this creates less pressure fluctuations than would be the case if solvent were added into the main ink circulation system. However, a problem can potentially arise when adding solvent into the gutter return line because the system is generally configured to ensure minimum vacuum and air-flow is maintained through the gutter and gutter line. This means that there is little spare vacuum capacity available to draw additional solvent into the gutter line with the result that, as a dose of solvent is added to the gutter line, there is a loss of vacuum further back in the line which could lead to unprinted ink spilling from the gutter.

It is an object of this invention to provide a continuous inkjet printer, and/or a method of operating a continuous inkjet printer, that will go at least some way in addressing aforementioned problems; or which will at least provide a novel and useful choice.

SUMMARY OF THE INVENTION

Accordingly, in a first aspect, the invention provides a method of controlling the operation of a continuous inkjet printer having a gutter line; a vacuum facility configured to create a vacuum in said gutter line; and a solvent-add line communicable with said gutter line, said method being characterised in that it includes causing said vacuum facility to increase the vacuum in said gutter line when said solvent add line is placed in communication with said gutter line.

Preferably said method further includes restricting a flow of solvent through said solvent-add line.

Preferably said vacuum facility includes a variable-speed pump, said method comprising increasing the vacuum in said gutter line by raising the speed of said variable-speed pump.

Preferably said method comprises monitoring noise in said gutter line as a control over the speed of said variable-speed pump.

Preferably said method comprises increasing the speed of said pump until the level of noise is indicative of annular flow in said gutter line.

In a second aspect, the invention provides a method of controlling the operation of a continuous inkjet printer having a gutter; a gutter line linking said gutter to an ink reservoir; a vacuum facility configured to create a vacuum in said gutter line back to said gutter; and a solvent-add line communicable with said gutter line, said method being characterised in that it includes controlling said vacuum facility to ensure that, when said solvent-add line is in communication with said gutter line, vacuum is maintained at said gutter.

Preferably said method comprises controlling said vacuum facility to ensure a substantially constant vacuum level is maintained at said gutter whether or not said solvent-add line is in communication with said gutter line.

Preferably said method includes controlling said vacuum facility to maintain a characteristic level of vacuum noise in said gutter line when said solvent-add line is in communication with said gutter line.

Preferably said method includes controlling said vacuum facility to maintain a level of vacuum noise characteristic of annular flow in said gutter line.

Preferably said vacuum facility includes a variable-speed pump, said method comprising varying the speed of said variable-speed pump.

Preferably the speed of said pump is varied in steps while monitoring vacuum noise in said gutter line.

Preferably said method includes maintaining said solvent-add line in communication with said gutter line for a time period sufficient to enable a defined volume of fluid passing through said solvent-add line to enter said gutter line.

In a third aspect, the invention provides a method of controlling the operation of a continuous inkjet printer having a gutter; a gutter line linking said gutter to an ink reservoir; a vacuum facility configured to create a vacuum in said gutter line back to said gutter; and a solvent-add line communicable with said gutter line, said method being characterised in that it includes controlling said vacuum facility to control the addition into said gutter line of fluid passing through said solvent-add line.

Preferably said vacuum facility includes a variable-speed pump, said method including controlling said vacuum by controlling the speed of said variable-speed pump.

Preferably said method is applied in combination with a method to measure and control the viscosity of ink circulating in said printer.

Preferably said method includes determining if said viscosity is below, at or above a target value.

Preferably, if said viscosity is below said target value, the speed of said variable speed pump is increased while said solvent-add line is maintained out of communication with said gutter line.

Preferably, if said viscosity is above said target value, said method comprises applying a viscosity control program determined according to the amount by which a measured viscosity varies from said target value.

Preferably said method comprises selecting a viscosity control program from three control programs. Said control programs may comprise a Very High program, a High program and a Normal program.

Preferably said Very High program comprises adding solvent into said gutter line for a maximum defined time period.

Preferably said High program comprises adding solvent into said gutter line for a time period calculated having regard to ink viscosity, solvent viscosity and gutter vacuum.

Preferably said Normal program comprises adding solvent into said gutter line in substantially constant volumes.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

The various aspects of the invention will now be described with reference to the accompanying drawings in which.

DETAILED DESCRIPTION OF WORKING EMBODIMENT

Figure 1:
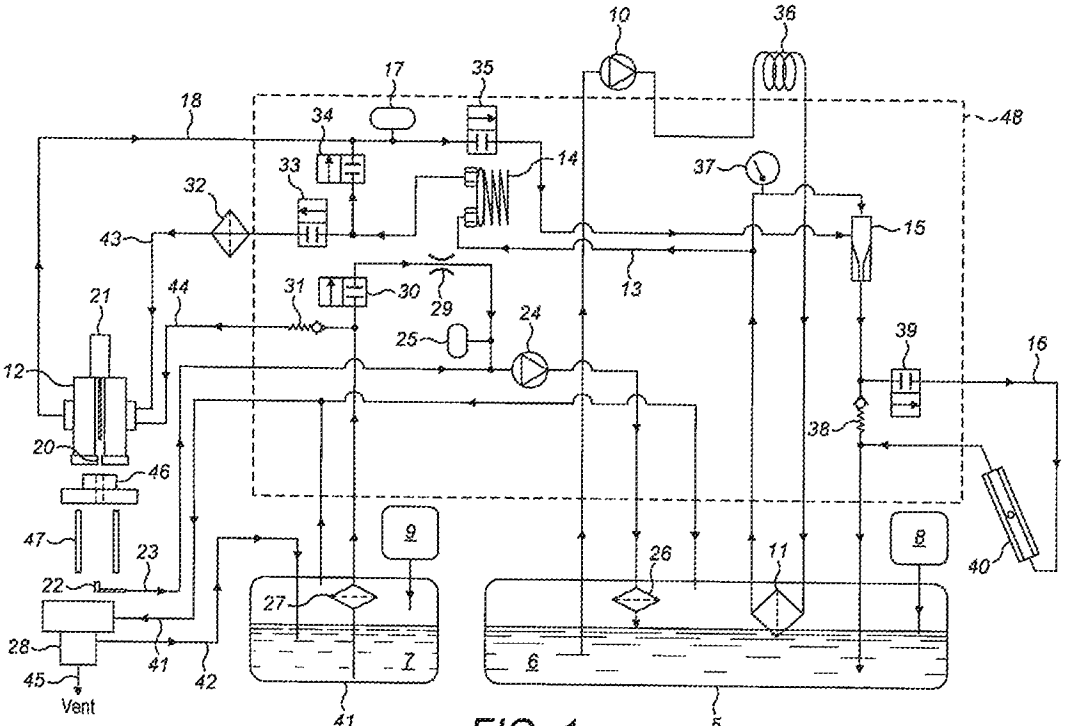
FIG. 1: shows a schematic operating diagram of a continuous inkjet printer suitable for performing the invention.

Referring to FIG. 1 a continuous inkjet printer, in this case a single-jet continuous inkjet printer, is shown in diagrammatic form, the printer drawing ink from ink reservoir 6 and make-up fluid or solvent from reservoir 7. The interiors of reservoirs 6 and 7 typically stand at ambient pressure and are topped-up from ink and solvent cartridges 8 and 9 respectively.

Ink is drawn from the reservoir 6 by feed pump 10. The pump 10 pushes the ink through an ink cooler 36 and through a fine system filter 11. Ink is then directed either to the print head drop generator 12, through feed line 13, via a damper 14; or through a jet pump 15 and back to the reservoir 6. The ink flow through the jet pump can also be directed through a viscometer loop 16, containing a viscometer 40, to enable the viscosity of the ink to be determined. In stand-by mode, when the printer is not printing, all ink circulates through the jet pump 15 and back to the reservoir 6. In this state the flow of ink is comparatively high while the pressure is comparatively low.

Restrictors are used to balance the flows between the feed path to the print head and the circulation path back to the reservoir. The drop generator 12 requires a low flow of the order of 5 ml/min at a high pressure of around 3 bar, whilst the jet pump 15 and viscometer loop 16 require a much higher flow of the order of 800 ml/min at a much lower pressure.

The pressure at the drop generator 12 is measured by pressure transducer 17 included in the bleed line 18.

In the conventional manner, upon opening the nozzle valve 21, ink is jetted through the print head nozzle 20 and the jet of ink is aligned such that it enters the ink catcher or gutter 22 and is returned to the printer via a gutter line 23. A gutter pump 24 draws a vacuum in the gutter line 23, pressure sensor 25 being attached to the gutter line 23, prior to the gutter pump 24, to monitor the vacuum in the gutter line. The ink and air mixture returned by the gutter pump 24 is directed back into reservoir 6, via a gutter filter 26.

The gutter pump 24 is preferably an electrically driven variable-speed diaphragm pump.

An essential feature of a continuous inkjet printer is a facility for adding solvent or make-up to the ink to compensate for solvent that is evaporated off during circulation through the print head. As stated above, if the viscometer 40 measures an undesirable increase in the viscosity of the ink, then solvent or make-up is added from the reservoir 7. In the embodiment shown, make-up is added by opening make-up valve 30 and allowing make-up fluid to be drawn by the gutter pump through the solvent-add line into the gutter line 23. It is advantageous to add make-up into the gutter line to avoid or at least reduce the pressure fluctuations experienced when adding make-up into the main circulation system. The make-up is preferably added close to the inlet of pump 24 where the vacuum is highest.

In order to minimise the amount of solvent vented off, circulation through the gutter line 23 is subjected to feedback control to ensure minimum vacuum and minimum airflow are being used. The disadvantage of this is that there is typically little spare vacuum capacity for make-up to be added to the gutter line and, as a consequence, there is a risk of the vacuum being insufficient to clear the gutter during solvent addition. In this event unprinted ink could spill out of the gutter and damage the print medium. The invention addresses this problem by carefully controlling the vacuum level in the gutter line vacuum in the gutter line 23, as solvent is added, with the overall objective of maintaining a substantially constant vacuum level at the gutter.

Whilst a number of techniques might be employed to increase vacuum in the gutter line, it is convenient to do this by increasing the speed of the gutter pump 24. Depending on the geometry of the solvent feed line, it may also be necessary or desirable to place one or more restrictors 29 in the solvent-add line. The use of a restrictor in the solvent-add line is preferred to simply reducing the diameter of the line as a restrictor permits greater and more consistent control over the flow characteristics of solvent flowing through the line.

Speed variation of the pump 24 is preferably controlled having regard to vacuum noise in the gutter line. In normal operation, i.e. when solvent is not being added, the vacuum in the gutter line is controlled according to noise levels in the gutter line to maintain transition flow in the gutter line, transition flow being a state between annular flow and slug flow. This is described in greater detail in our co-pending International Patent Application No. PCT/GB2017/051318. We have found that this flow state ensures reliable clearing of the gutter while minimising solvent consumption. According to the preferred aspect of this invention, gutter line noise is also used as a control over the vacuum level in the gutter line for solvent addition but, when solvent is to be added, the pump speed is increased until the noise level in the gutter line decreases to a level characteristic of annular flow. The speed of pump 24 preferably increased in increments until a steady low level of noise is observed. At that stage the make-up valve 30 is opened to allow solvent to flow into the gutter line.

Those skilled in the art will appreciate that control over the addition of solvent forms part of a greater regime to control the viscosity of ink circulating through the printer. We have found that viscosity control is effected most efficiently by adopting different routines depending on the direction to which, and the extent to which, measured viscosity varies from a predetermined target value.

In normal operation, ink is circulated through viscometer 40 every 180 seconds and a viscosity reading taken. That reading then determines if viscosity adjustment is required and, if required, how that adjustment should be effected.

Figure 2:
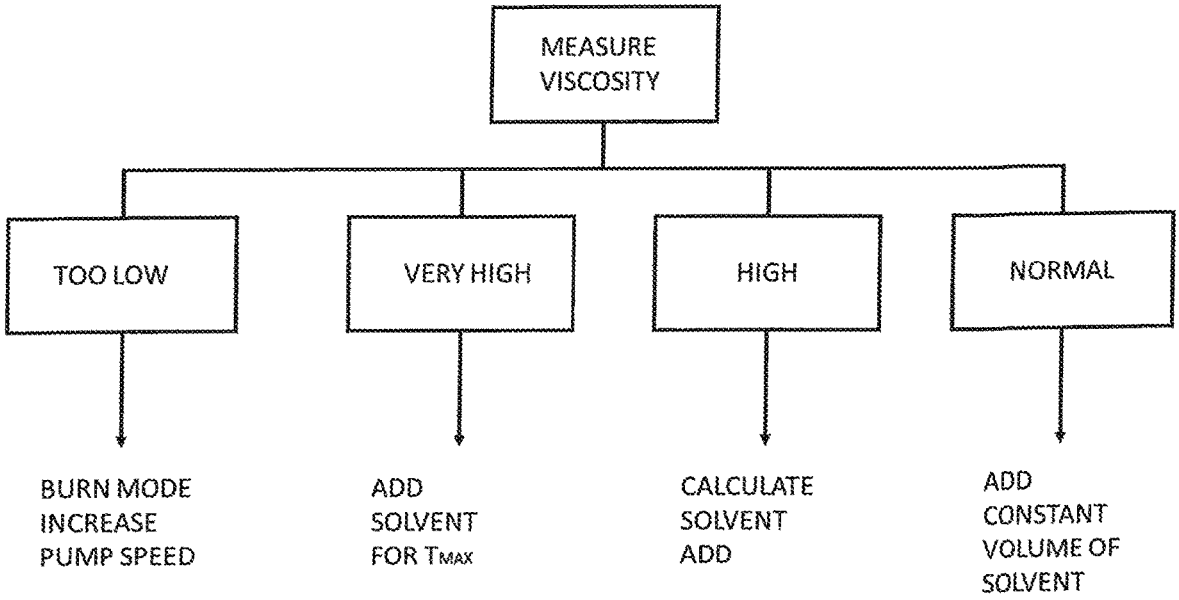
FIG. 2: shows a flow diagram showing various routes for altering viscosity according to the invention.

Referring to FIG. 2, if the measured viscosity is greater than, say, 0.2 Cp below the target value of 3.8 cP then a 'burn-off' cycle is initiated to evaporate solvent circulating in the printer and thus cause viscosity to rise. In the preferred embodiment of this invention burn-off is achieved by increasing the speed of pump 24 for a defined time period which draws more air into the gutter line 23.

If the viscosity exceeds the target then, according to the embodiment described, one of three routines is followed. If the measured viscosity exceeds the target by, say, 1.5 cP over the target value, then this is defined as a Very High situation and, as shown in FIG. 2, is addressed by the valve 30 being held open for a defined period of time, say 15 seconds, to allow a significant dose of solvent to be added. This routine stops when the measured viscosity reaches a value 0.5 cP above the target. If the measured viscosity is greater than 0.2 cP but less than 0.5 cP above the target level, then this is defined as a High situation and a calculation is applied to determine the amount of solvent to be added, the calculation taking into account, gutter vacuum, actual solvent viscosity and actual ink viscosity. This calculation determines an opening time for the valve 30. If the measured viscosity exceeds the target by more than 0.02 then a Normal situation is implied and solvent is added in defined volumes established by an opening time of the valve 30.

Those skilled in the art will appreciate that the figures mentioned above are examples only and that different applications may require different target viscosities and different levels of viscosity defining the Very High, High, Normal and Too Low bands described above.

The invention thus provides an effective means of adding make-up fluid into the ink circuit of a continuous inkjet printer while maintaining desired levels of vacuum at the gutter.

The invention claimed is:

1. A method of controlling the operation of a continuous inkjet printer having a gutter line; a vacuum facility including a variable-speed pump configured to create a vacuum in said gutter line; and a solvent-add line communicable with said gutter line, said method comprising the steps of:

selectively placing said solvent-add line in communication with said gutter line; and causing said vacuum facility to increase the vacuum in said gutter line by raising the speed of said variable-speed pump before the step of placing said solvent add line in communication with said gutter line.

2. The method as claimed in claim 1 further including restricting a flow of solvent through said solvent-add line.

3. The method as claimed in claim 1 comprising:

monitoring noise in said gutter line as a control over the speed of said variable speed pump.

4. The method as claimed in claim 3 comprising increasing the speed of said pump until the level of noise is indicative of annular flow in said gutter line.

5. The method as claimed in claim 2 comprising:

monitoring noise in said gutter line as a control over the speed of said variable speed pump.

6. The method as claimed in claim 5 comprising increasing the speed of said pump until the level of noise is indicative of annular flow in said gutter line.

7. A continuous inkjet printer comprising:

a gutter line;

a vacuum facility including a variable-speed pump configured to create a vacuum in said gutter line;

a solvent-add line communicable with said gutter line; and a controller operable to selectively place said solvent-add line in communication with said gutter line and to cause said vacuum facility to increase the vacuum in said gutter line by raising the speed of said variable-speed pump before placing said solvent-add line in communication with said gutter line.

8. The continuous inkjet printer as claimed in claim 7 further including a restrictor to restrict a flow of solvent through said solvent-add line.

9. The continuous inkjet printer as claimed in claim 7, wherein said controller is operable to monitor noise in said gutter line as a control over the speed of said variable-speed pump.

10. The continuous inkjet printer as claimed in claim 9 wherein said controller is operable to increase the speed of said pump until the level of noise is indicative of annular flow in said gutter line.

11. The continuous inkjet printer as claimed in claim 8 wherein said controller is operable to monitor noise in said gutter line as a control over the speed of said variable-speed pump.

12. The continuous inkjet printer as claimed in claim 11 wherein said controller is operable to increase the speed of said pump until the level of noise is indicative of annular flow in said gutter line.

* * * * *